US007964799B2

(12) United States Patent
Isberg et al.

(10) Patent No.: US 7,964,799 B2
(45) Date of Patent: Jun. 21, 2011

(54) BUSHING

(75) Inventors: Peter Isberg, Västerås (SE); Carina Önneby, Västerås (SE); Erik Johansson, Västerås (SE); Thomas Liljenberg, Västerås (SE); Douglas Getson, Jefferson City, MO (US)

(73) Assignee: ABB Research Ltd., Zürich (CH)

( * ) Notice: Subject to any disclaimer, the term of this patent is extended or adjusted under 35 U.S.C. 154(b) by 656 days.

(21) Appl. No.: 10/564,198

(22) PCT Filed: Jun. 17, 2004

(86) PCT No.: PCT/SE2004/000984

§ 371 (c)(1),
(2), (4) Date: May 1, 2007

(87) PCT Pub. No.: WO2005/006355

PCT Pub. Date: Jan. 20, 2005

(65) Prior Publication Data

US 2007/0272432 A1 Nov. 29, 2007

(30) Foreign Application Priority Data

Jul. 11, 2003 (SE) ..... 0302091

(51) Int. Cl.
*H01B 17/26* (2006.01)

(52) U.S. Cl. ..... 174/152 R; 174/142; 174/137 R; 16/2.1; 16/2.2; 29/592.1

(58) Field of Classification Search ..... 174/152 G, 174/153 G, 152 R, 17 CT, 30, 31 R, 137 R, 174/135, 143, 12 BH, 142; 248/56; 16/2.1, 2.2; 29/592.1

See application file for complete search history.

(56) References Cited

U.S. PATENT DOCUMENTS

| | | | | |
|---|---|---|---|---|
| 3,883,680 | A * | 5/1975 | Keen, Jr. | 174/31 R |
| 4,401,841 | A * | 8/1983 | Meyer et al. | 174/31 R |
| 4,431,859 | A * | 2/1984 | Kishida | 174/31 R |
| 4,500,745 | A * | 2/1985 | Miggins | 174/31 R |
| 6,088,875 | A | 7/2000 | Ono et al. | |
| 6,156,979 | A * | 12/2000 | Pioch | 174/152 G |
| 7,262,367 | B2 * | 8/2007 | Donzel et al. | 174/137 R |
| 2001/0008330 | A1 | 7/2001 | Sakata | |

FOREIGN PATENT DOCUMENTS

| | | | |
|---|---|---|---|
| CN | 2058269 | U | 6/1990 |
| CN | 2061729 | U | 9/1990 |
| CN | 2399805 | Y | 10/2000 |
| CN | 2522990 | Y | 11/2002 |
| GB | 2058482 | A | 4/1981 |
| JP | 9153315 | A | 6/1997 |

OTHER PUBLICATIONS

People's Republic of China—First Office Action—Aug. 21, 2009.
Notification of Second Office Action—May 10, 2010.

* cited by examiner

*Primary Examiner* — Angel R Estrada
(74) *Attorney, Agent, or Firm* — Venable LLP; Eric J. Franklin

(57) ABSTRACT

A bushing for an electrical device including an insulating core, where at least a part of the insulating core includes a continuous diffusion barrier with firm adhesion to the insulating core. The bushing is manufactured by coating at least a part of the insulating core with the continuous diffusion barrier.

16 Claims, 3 Drawing Sheets

BUSHING

CROSS-REFERENCE TO RELATED APPLICATIONS

This application claims priority under 35 USC §119 to Swedish patent application no. 0302091-4 filed on 11 Jul. 2003 and is the national phase application of PCT/SE2004/000984 under 35 U.S.C. §371.

TECHNICAL FIELD

The present invention relates to an indoor or outdoor bushing and a method for constructing said bushing.

BACKGROUND ART

The primary function of a bushing is to carry current through a grounded barrier, such as a wall or an enclosure of an electrical apparatus. The bushing keeps current from passing into the grounded barrier by virtue of its insulating properties. A bushing is built with or without a condenser.

A non-condenser bushing comprises a current carrying center conductor surrounded by a solid, liquid or gas dielectric medium and a ceramic- or elastomeric insulator.

A condenser bushing for medium- and high-voltage has an additional component called an insulating core that aids electrical field distribution along the length of the bushing. The insulating core is built up around a central tube that is in the current carrying path of the bushing. For some types of bushings the central tube is not in the current carrying path of the bushings. The medium- and high-voltage bushing insulating cores are for example constructed of either oil impregnated paper (OIP) or resin impregnated paper (RIP). Wound with the paper is a plurality of equalization plates arranged concentrically within the core. These layers are constructed of metallic foil, preferably aluminum foil, or conductive ink, which serve to control the electrical field internal and external to the bushing assembly.

The resin impregnated paper insulating core may be produced by winding paper and equalization plates on the center tube and then impregnating with a resin in a mould. The resin used in a resin impregnated paper insulating core is for example epoxy. The mould may also be the actual elastomeric sheath that becomes part of the final product assembly. The mould could also be made of paper or metal that is removed after the curing process. When using a removable mould, an elastomeric sheath is extruded directly on to the resin impregnated paper insulating core. The resin impregnated paper insulating core could also be placed inside a hollow glass fiber reinforced epoxy cylinder with an elastomeric sheath extruded directly on its outer surface or placed inside a hollow ceramic cylinder. There are certain constructions that do not require either the elastomeric sheath or the hollow ceramic cylinder after removal from the mould. Outfitting with a mounting flange along with several other components, such as mechanical fittings, possibly an expansion tank, completes the bushing assembly.

The elastomeric sheath made of silicon or EP-rubber, along with the ceramic insulator act to prevent creepage current along the outer surface of the bushing assembly. Both the elastomeric and ceramic insulator have bell shaped protrusions called sheds that increase the creepage distance along its length and further reduce the incidence of creepage current.

When using a hollow glass fiber reinforced epoxy cylinder or a hollow ceramic cylinder as insulator, the space between the insulating core and the outer hollow insulator is filled with a solid, semi-solid, liquid or gaseous dielectric medium. An example of a liquid dielectric medium is oil and an example of a gaseous dielectric medium is $SF_6$.

Epoxy and elastomers absorb moisture when exposed to the atmospheric conditions. Resin impregnated paper bushings with or without elastomeric sheathing extruded directly on its insulating core is susceptible to moisture absorption during long term exposure to atmospheric conditions. Moisture absorption into the insulating core may cause degradation of the dielectric integrity of the bushing and diminish its ability to serve its intended purpose.

To prevent water from reaching the epoxy, there are known temporary solutions employed by the industry such as plastic or desiccants, or a cost prohibitive metal enclosure. There is no cost effective and reliable method known today for having a protective layer that keeps the moisture away from the epoxy. One reason for this is the limited adhesion and temperature stability of such known protective layer.

Therefore there is a need for a bushing where moisture uptake in the condenser core is prevented and a method of manufacturing such a bushing, which is simpler, more economical than known methods, and results in a finished product of high quality.

SUMMARY OF THE INVENTION

The object of the invention is to provide a medium-voltage or high-voltage bushing for an electric device, the bushing comprising an insulating core, where moisture from the atmosphere outside the bushing is prevented to diffuse into the insulating core. It is a further object to provide a method for manufacturing said bushing.

This object of the invention is obtained by a bushing and a method for manufacturing a bushing according to the present invention.

The object of the invention is achieved in that at least a part of the insulating core of the bushing comprises a continuous diffusion barrier to prevent moisture ingress. The diffusion barrier comprises a continuous film of a thin and flexible material with firm adhesion to the insulating core. The continuous film is an electrical insulator and is thermally stable. With flexible material is meant a material, which is able to withstand strain without being permanently affected or injured. With firm adhesion is meant that the diffusion barrier is keeping its adherence to the insulating core at mechanical or thermal strain.

Further advantageous features of the bushing and the manufacturing method are stated in the description below and in the dependent claims.

The diffusion barrier comprises at least one of the following; an inorganic film, an organic film or an organic/inorganic hybrid film. According to a preferred embodiment of the invention the diffusion barrier comprises a multi-layer film.

According to a further preferred embodiment the diffusion barrier comprises particles of hybrid or inorganic nature. The particles are incorporated in the matrix of the inorganic film, the organic film, the organic/inorganic hybrid film or the multi-layer film.

The diffusion barrier is for example deposited on at least part of the insulating core by one of the following coating methods; painting, dipping, spraying, plasma arc, sol-gel technique, Physical Vapor Deposition (PVD) or Chemical Vapor Deposition (CVD). When the diffusion barrier is a multi-layer film comprising two or more layers, the diffusion barrier could be applied by a combination of the above mentioned methods.

As the diffusion barrier is made of a continues and flexible material with firm adhesion to the insulating core, cracking of the diffusion barrier will be eliminated. The diffusion barrier protects the insulating core from water uptake during operation, storage and transport.

Another advantage is that a bushing with a diffusion barrier, applied with at least one of the above-mentioned methods, is easy to manufacture compared to known protective layers for bushings.

A further advantage is eliminating the need for the outer hollow bushing that works today as a protecting structure for the insulting core. The diffusion barrier also enables the possibility to directly apply an outer tubular member comprising an elastomer on the outside of the insulating core as creepage current protection. The outer tubular member is provided with bell shaped protrusions called sheds.

The diffusion barrier enables open transport and storage in humid environments which eliminates the need for pre-treatment such as heating or slow start of the electrical system when energized, which is used today to drive the water out from the insulating core.

BRIEF DESCRIPTION OF THE DRAWINGS

The invention will be described in greater detail by description of embodiments with reference to the accompanying drawings, wherein.

DESCRIPTION OF PREFERRED EMBODIMENTS

The following description refers to both the method and the device.

Figure 1:
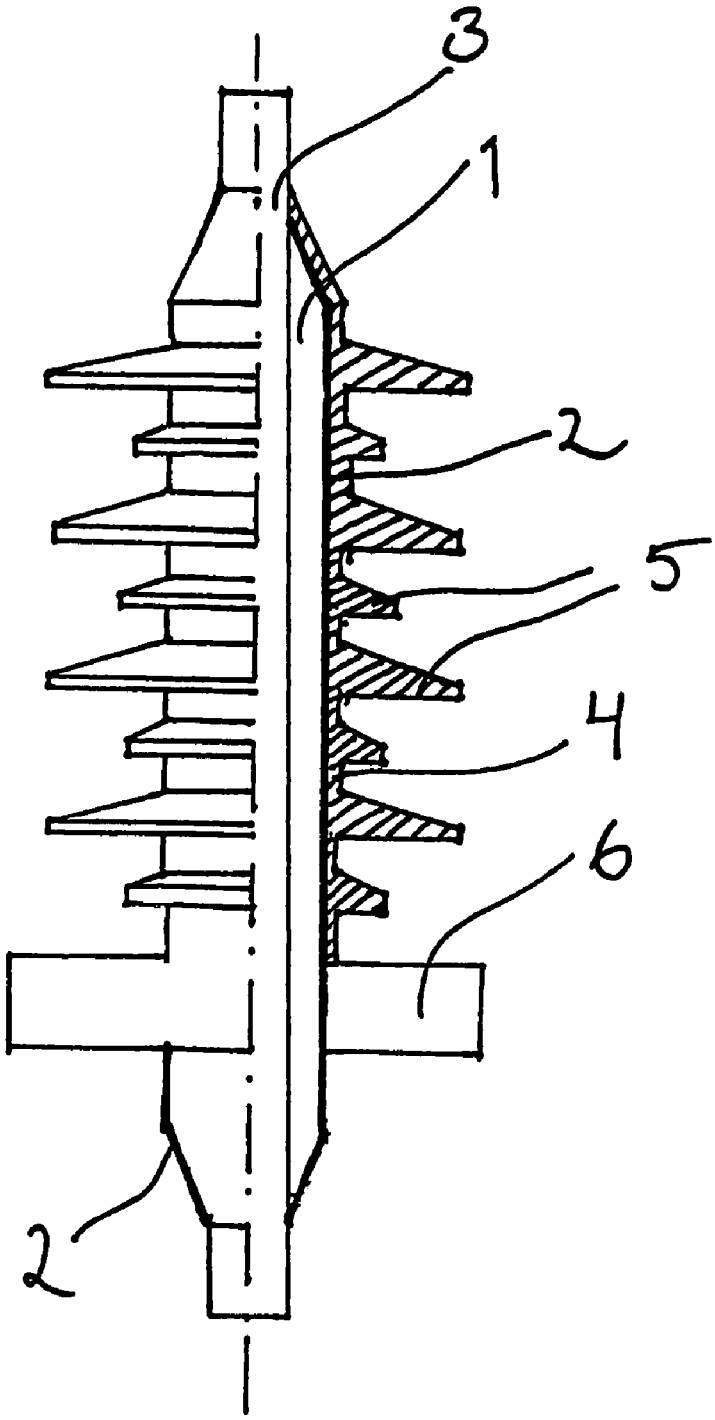
FIG. 1 shows schematically in a side view and partly in a longitudinal cross section, a bushing according to a preferred embodiment of the invention.

FIG. 1 shows a bushing according to a preferred embodiment of the invention. The bushing comprises an insulating core 1 comprising a diffusion barrier 2. The diffusion barrier 2 comprises a continuous film, which covers essentially the entire surface of the insulating core in FIG. 1. A center tube 3 is arranged in the center of the bushing. The center tube 3 may or may not be in the current carrying path. The insulating core is for example made of a composite material comprising epoxy, such as epoxy resin impregnated paper (RIP). The insulating core may be produced by winding paper and equalization plates on the center tube and then impregnating with a resin in a mould. These equalization plates (not shown) are constructed of metallic foil, preferably aluminum foil, or conductive ink, which serve to control the electrical field internal and external to the bushing assembly.

To avoid creepage current an outer tubular member 4 of an elastomeric, such as silicon or EP-rubber, or ceramic material is arranged on the outside of the insulating core. The outer tubular member 4 is provided with bell shaped protrusions called sheds 5. A flange 6 is arranged radially on the insulating core for fastening the bushing to the wall to an electrical device, such as a transformer.

Figure 2:
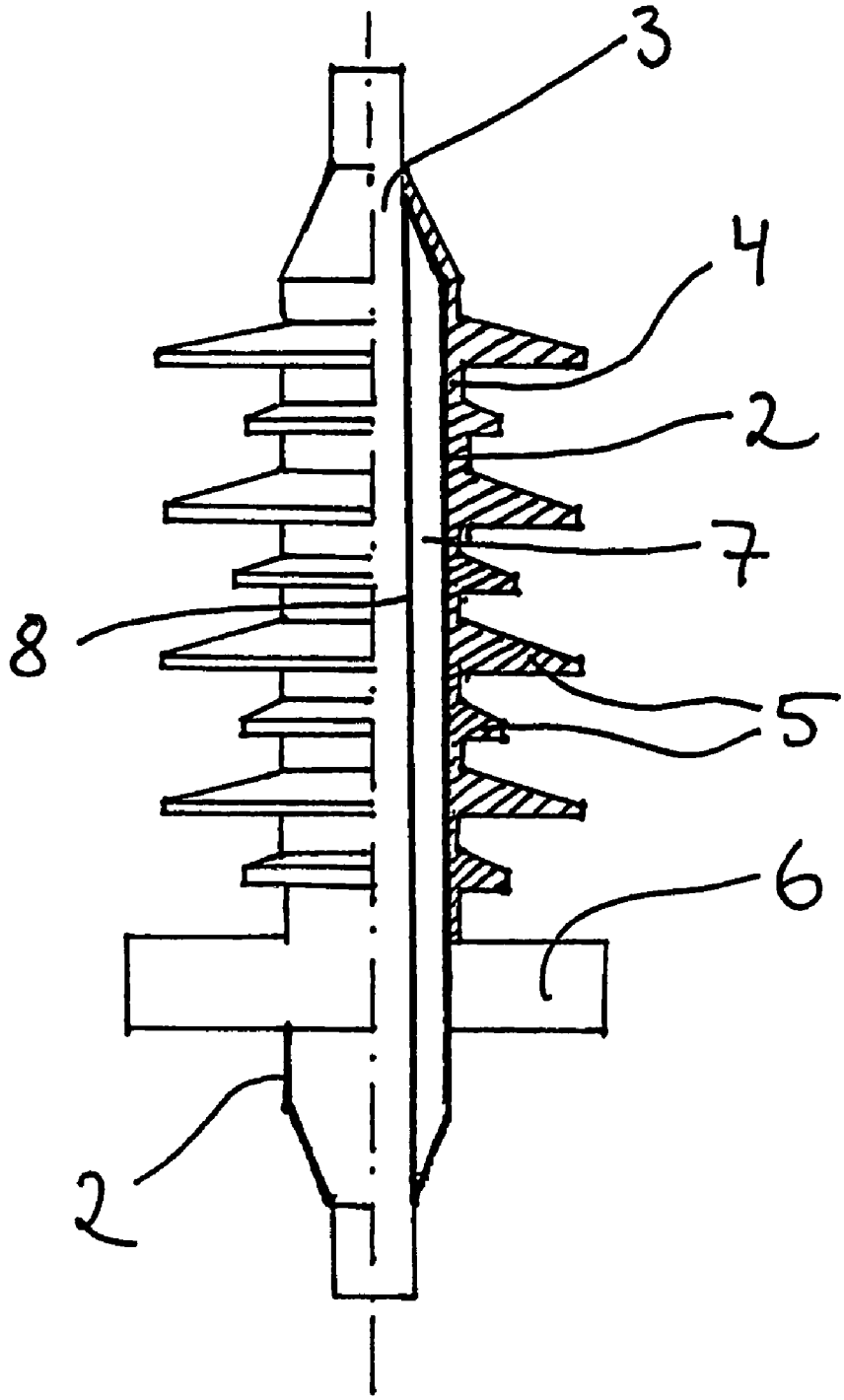
FIG. 2 shows schematically in a side view and partly in a longitudinal cross section, a bushing according to another embodiment of the invention.
Figure 3:
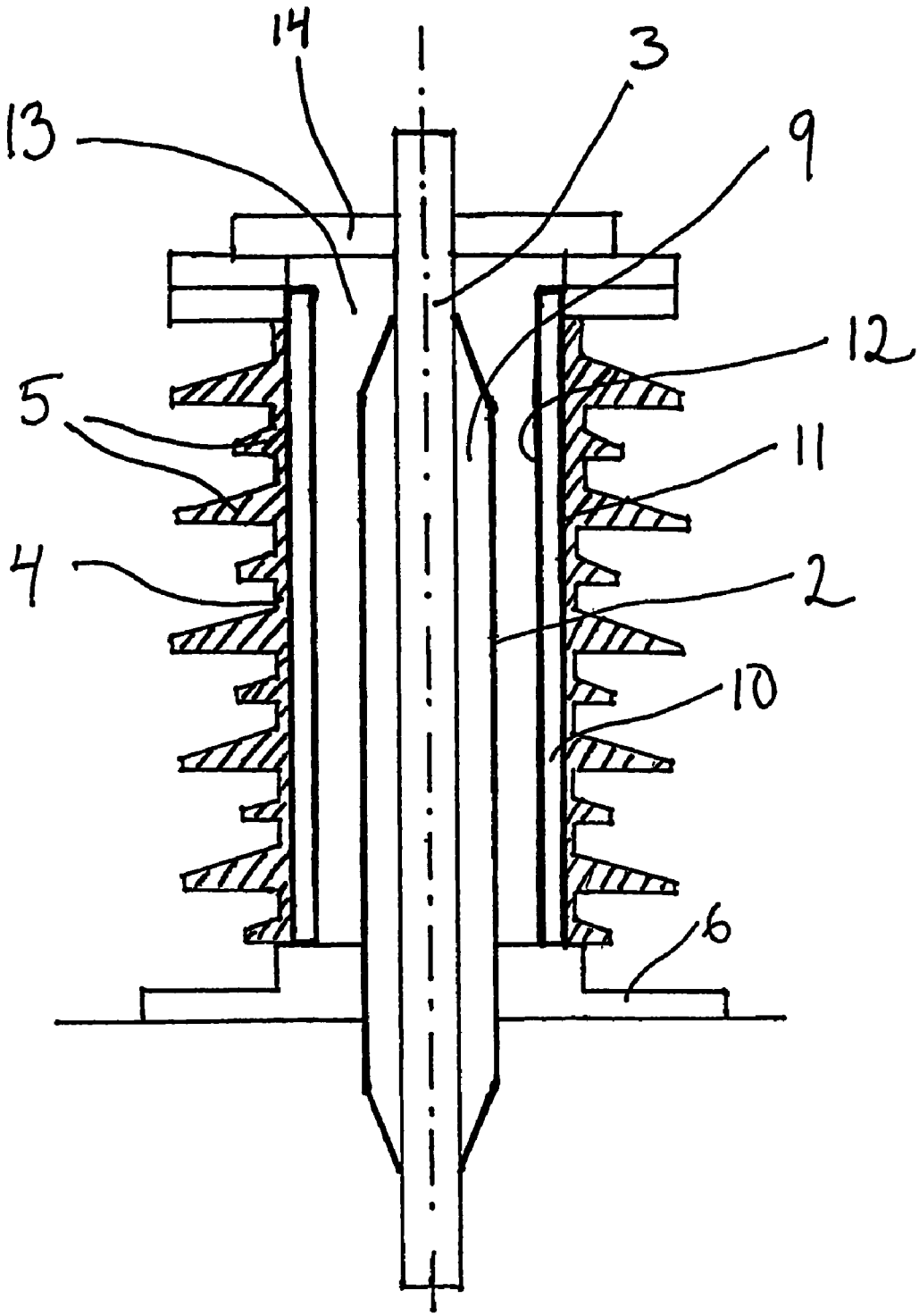
FIG. 3 shows schematically in a longitudinal cross section, a bushing with an outer hollow insulator according to a further embodiment of the invention.

In FIG. 1-3 the diffusion barrier 2, 8, 11, 12 according to the invention is made as a continuous film, which is thin and flexible. The diffusion barrier has firm adhesiveness to epoxy and has insulating properties.

The diffusion barrier 2, 8, 11, 12 has low water permeability. Preferably the coefficient of water permeability is lower than 0.1 $g.m^{-2}.day^{-1}$. Most preferably the coefficient of water permeability is lower than 1 $mg.m^{-2}.day^{-1}$.

According to one embodiment the diffusion barrier 2, 8, 11, 12 comprises an organic matrix such as a polymer, for example polyvinylchloride (PVC). In a preferred embodiment the organic matrix comprises incorporated small inorganic particles or particles of hybrid material, in the range from nanometer to several micrometers. A hybrid particle is a particle comprising both organic and inorganic bonds in the matrix as well as on the surface of an inorganic particle.

In another embodiments of the invention the diffusion barrier 2, 8, 11, 12 comprises an inorganic matrix such as aluminum oxide ($Al_2O_3$), or silicone oxide ($SiO_x$). In a preferred embodiment the inorganic matrix comprises incorporated small inorganic particles or hybrid particles, in the range from nanometer to several micrometers.

According to a preferred embodiment of the invention the diffusion barrier 2, 8, 11, 12 comprise an organic/inorganic hybrid matrix. An organic/inorganic hybrid film is for example a film comprising at least one layer with an organic matrix and at least one layer with an inorganic matrix. Another example of an organic/inorganic hybrid film is a film with a combination of an organic and inorganic matrix network. The organic/inorganic hybrid matrix may also comprise incorporated small inorganic particles or hybrid particles, in the range from nanometer to several micrometers. One example of a hybrid film with small particles is a silica-based film applied with sol-gel technique comprising small flat inorganic particles of hexagonal boron nitride (h-BN).

According to another preferred embodiment of the invention the diffusion barrier 2, 8, 11, 12 comprises a multi-layer film. A multi-layer film comprises at least two of the above-described matrixes with or without particles. A multi-layer film is for example a film comprising at least one layer with an organic matrix and at least one layer with an inorganic matrix. Other examples of a multi-layer film are an organic film comprising at least two layers with different organic matrixes, or an inorganic film comprising at least two layers with different inorganic matrixes.

According to another preferred embodiment of the invention the incorporated particles have a designed shape, such as flaky or flat particles. Flaky or flat particles have the advantages that they will not contribute to increase the film thickness if aligned flat in the surface, and that they effectively increase the diffusion path for the diffusing molecules. Examples of preferred particles are h-BN and mica, which has a flaky nature, and flat $SiO_2$ and $Al_2O_3$ particles.

The diffusion barrier 2, 8, 11, 12 is for example applied by one of the following coating methods; painting, dipping, spraying, plasma arc, sol-gel technique, Physical Vapor Deposition (PVD) or Chemical Vapor Deposition (CVD).

Coatings of hybrid materials are preferably produced by sol-gel technique, which means that a chemical solution containing precursors to the coating material is applied on the surface, and thereafter the surface is dried and hardened. The hardening may be at room temperature, made by UV and/or at elevated temperature. Application of the solution is made by, for example, dipping, spraying or painting of the object to be coated.

The thickness of the diffusion barrier depends on the material of the coating. Preferably a diffusion barrier of an organic film has a thickness less than 5 mm, while a diffusion barrier of an inorganic or a hybrid film preferably has a thickness in the order of micrometer to tens of micrometer.

Although the insulating core 1 shown in FIG. 1 is arranged directly on the center tube 3, the insulating core may also be manufactured as a separate part with a through hole arranged longitudinally, for later assembly on the center tube 3. FIG. 2 shows schematically in a side view and partly in a longitudinal cross section, a bushing according to another embodiment of the invention. The inside and outside of a hollow insulating core 7 being at least partly coated with a diffusion barrier 8 comprising a continuous film.

According to a further embodiment of the invention, the hollow insulating core 7 is coated on both the inside and the outside with the diffusion barrier.

A further preferred embodiment of the invention is shown in FIG. 3, where a schematically longitudinal cross section of a bushing comprising an insulating core 9 and an outer hollow insulator 10 is shown. The outer hollow insulator 10 being at least partly coated with a diffusion barrier 11, 12 comprising a continuous film.

According to a further preferred embodiment of the invention, essentially the whole surface of the outer hollow insulator 10 is coated with the diffusion barrier 2, 8, 11, 12 comprising a continuous film. When the bushing has been attached to an electrical device and a top cover 14 arranged to the other side, the space 13 between the insulating core 9 and the outer hollow insulator 10 is filled with a solid, semi-solid, liquid or gaseous dielectric medium, such as oil or $SF_6$. A tubular member 4 comprising several radial protruding sheds 5 of an elastomeric material, such as silicon rubber or EP-rubber is attached to the outer hollow insulator 10.

Since only certain preferred embodiments of the present invention have been described, many modifications and changes will be apparent to those skilled in the art without departing from the scope of the invention, such as this is defined in the appended claims with support from the description and the drawings.

Accordingly the diffusion barrier 2, 8, 11, 12 may be applied on the outside and/or the inside of the insulating core 1, 7, 9 and/or the inside and/or the outside of the outer hollow insulator 10. The diffusion barrier could also be applied on the outside of the tubular member 4.

The invention claimed is:

1. A bushing for an electrical device, comprising:

an insulating core comprising a composite material comprising epoxy resin impregnated paper and having an exterior surface; and a continuous moisture diffusion barrier at least partially covering the exterior surface of the insulating core, the continuous moisture diffusion barrier comprising a continuous film with firm adhesion to the insulating core.

2. The bushing according to claim 1, wherein the insulating core is hollow and that at least part of the inside of the insulating core is coated with the moisture diffusion barrier.

3. The bushing according to claim 1, further comprising:

an outer hollow insulator arranged outside the insulating core, wherein at least a part of the outer hollow insulator is coated with the moisture diffusion barrier.

4. The bushing according to claim 3, wherein essentially the whole surface of the outer hollow insulator is coated with the moisture diffusion barrier.

5. The bushing according to claim 3, wherein the moisture diffusion barrier is deposited on at least part of the insulating core and/or the outer hollow insulator by one of the following methods: dipping, painting, spraying, plasma arc, sol-gel technology, Physical Vapor Deposition or Chemical Vapor Deposition.

6. The bushing according to claim 1, wherein the moisture diffusion barrier comprises at least one of the following: an organic film or an organic/inorganic hybrid film.

7. The bushing according to claim 1, wherein the moisture diffusion barrier comprises a multi-layer film.

8. The bushing according to claim 1, wherein the moisture diffusion barrier comprises particles of hybrid or inorganic nature.

9. The bushing according to claim 1, wherein the moisture diffusion barrier has a coefficient of water permeability smaller than 0.1 $g.m^{-1}.day^{-1}$.

10. A method for manufacturing a bushing for an electrical device, the bushing comprising an insulating core, the method comprising:

coating at least a part of an exterior surface of the insulating core comprising a composite material comprising epoxy resin impregnated paper with a continuous moisture diffusion barrier comprising a continuous film with firm adhesion to the insulating core.

11. The method according to claim 10, wherein the insulating core is hollow, and wherein at least part of the inside of the insulating core is coated with the moisture diffusion barrier.

12. The method according to claim 10, further comprising:

arranging an outer hollow insulator outside the insulating core, and coating at least a part of the outer hollow insulator with the moisture diffusion barrier.

13. The method according to claim 12, wherein essentially the whole surface of the outer hollow insulator is coated with the moisture diffusion barrier.

14. The method according to claim 12, wherein the insulating core and/or the outer hollow insulator is coated with the moisture diffusion barrier comprising at least one of the following: an inorganic film, an organic film or an organic/inorganic hybrid film.

15. The method according to claim 11, wherein the moisture diffusion barrier is deposited on at least part of the insulating core and/or the outer hollow insulator, by one of the following methods: painting, dipping, spraying, plasma arc, sol-gel technology, Physical Vapor Deposition or Chemical Vapor Deposition.

16. The method according to claim 10, wherein the insulating core is coated with a moisture diffusion barrier comprising a multi-layer film.

* * * * *